US006232886B1

(12) United States Patent
Morand

(10) Patent No.: US 6,232,886 B1
(45) Date of Patent: May 15, 2001

(54) METHOD AND APPARATUS FOR INDICATING METER TAMPERING

(75) Inventor: Gary W. Morand, Duluth, GA (US)

(73) Assignee: Schlumberger Resource Management Services, Inc., Norcross, GA (US)

( * ) Notice: Subject to any disclaimer, the term of this patent is extended or adjusted under 35 U.S.C. 154(b) by 0 days.

(21) Appl. No.: 09/220,387

(22) Filed: Dec. 23, 1998

(51) Int. Cl.[7] ..... G08B 23/00; G08C 15/06

(52) U.S. Cl. ..... 340/870.02; 340/870.16; 340/637; 324/110

(58) Field of Search ..... 340/870.02, 637, 340/635, 870.16; 307/132 EA; 700/306; 324/110

(56) References Cited

U.S. PATENT DOCUMENTS

| | | | |
|---|---|---|---|
| 4,001,777 | 1/1977 | Alexander . | |
| 4,195,286 | 3/1980 | Galvin . | |
| 4,302,750 | 11/1981 | Wadhwani et al. . | |
| 4,419,758 | 12/1983 | Dorey . | |
| 4,463,354 | 7/1984 | Sears . | |
| 4,542,337 | 9/1985 | Rausch . | |
| 4,588,949 | 5/1986 | Becker et al. . | |
| 4,611,197 | 9/1986 | Sansky . | |
| 4,614,945 | 9/1986 | Brunius et al. . | |
| 4,720,851 | 1/1988 | Smith . | |
| 4,786,903 | 11/1988 | Grindahl et al. . | |
| 4,799,059 | 1/1989 | Grindahl et al. . | |
| 4,804,957 | 2/1989 | Selph et al. . | |
| 4,833,618 | 5/1989 | Verma et al. . | |
| 4,850,010 | 7/1989 | Stanbury et al. . | |
| 4,856,054 | 8/1989 | Smith . | |
| 4,862,493 | 8/1989 | Venkataraman et al. . | |
| 5,056,107 | 10/1991 | Johnson et al. . | |
| 5,086,292 | 2/1992 | Johnson et al. . | |
| 5,216,410 | 6/1993 | Pildner et al. . | |
| 5,473,322 | 12/1995 | Carney . | |
| 5,488,565 * | 1/1996 | Kennon et al. | 340/870.02 |

* cited by examiner

*Primary Examiner*—Michael Horabik
*Assistant Examiner*—Timothy Edwards, Jr.
(74) *Attorney, Agent, or Firm*—Dority & Manning, P.A.

(57) ABSTRACT

Method and apparatus facilitate improved sensing of tampering of an electrically powered device, such as an electric watt-hour meter installed at a residence for metering the amount of electric energy consumed at the residence. The detected tampering involves an effort to remove the electric meter from its power socket, to interrupt the metering of electric energy consumption, or to otherwise gain access for diverting electric energy. Removal of the electric meter from its power socket interrupts power to the meter. The method and apparatus senses motion of the meter and sets a "Tamper Flag" in a non-volatile memory. The "Tamper Flag" is saved (i.e., is not cleared from the non-volatile memory) if loss of power to the meter occurs within a predetermined period of time. The "Tamper Flag" is cleared if there is no loss of power to the meter within the predetermined period of time. Upon detecting a resumption of power after a loss of power to the meter, an indication of sensed tampering is made if the "Tamper Flag" is set.

50 Claims, 2 Drawing Sheets

METHOD AND APPARATUS FOR INDICATING METER TAMPERING

BACKGROUND OF THE INVENTION

The present invention generally concerns improved methodologies and corresponding apparatuses for detecting tampering of electrically powered devices, and more particularly concerns efficient indicating of tampering of an electrically powered meter, such as an electric watt-hour meter. The subject invention concerns both apparatuses and methodologies in such areas, including in some instances the use of practical computer software applications involving an algorithmic approach to producing a useful, concrete and tangible result, i.e,, namely, indications of tampering with metrology functions and/or unauthorized diversion of electric energy.

As widely known and practiced, the delivery of various utilities, such as electricity, water or gas to consumers (such as occupying individual residences or apartments), is monitored by a metering device. In many instances, such metering device is electrically powered. For example, in the case of the delivery of electric power, an electric watt-hour meter may be used. In the case of a customer premises, typical residential installations will involve a single phase induction watt-hour meter, as well known to those of ordinary skill in the art.

Such an electric meter is detachable from a power socket in which it is intended to be received during normal metering operations thereof. While in the power circuit (i.e., in the power socket), the meter senses the consumption of electric energy, which data is used for billing purposes. Meter reading personnel periodically may inspect a customer installation for recording meter readings, either manually or with the use of electronic devices (such as probes or receivers) for retrieving data stored in a memory, such as a solid state non-volatile memory. Billing to the customer is established based on such collected data.

Tampering with a meter, such as an electricity meter, is an effort to defraud the electricity supplier of revenue to which it is rightfully entitled for the delivery of electric energy. Such tampering may be intended to perpetrate such fraud in one of several ways. For example, an electric utility meter might be removed for purposes of causing missed readings while electric energy is otherwise consumed. In another instance, a customer or other person, may seek to make unauthorized connections to or through the power socket, while the metering device is removed or while it is replaced after certain unauthorized connections are attempted. In yet another instance, it is understood that certain types of single phase meters can be removed and reinstalled "upside down" so as to result in a reverse rotation of an internal meter disk and register dials, which record cumulative energy consumption.

In each of the foregoing examples of actual or attempted tampering, one aspect of the tampering involves the removal of the electric meter and ultimate reinsertion of the meter in its power socket.

Prior methods and devices have been practiced for addressing the technical problem of sensing or detecting tampering of metering devices. One such example is disclosed in commonly owned U.S. Pat. No. 5,473,322, entitled "Apparatus and Method for Sensing Tampering with a Utility Meter." Such method employs a motion sensor for detecting removal of a meter and detects associated loss of power.

The exemplary prior method of the referenced '322 Patent is triggered by a motion sensor. If power failure is detected within a certain time thereafter, the combination of such facts is written as a tamper event to a non-volatile memory before powering down. While effective for its purposes, such approach requires specific circuitry for early detection of loss of power and an appropriate power supply having an adequate hold-up time to complete storage of the detected tampering event. In other words, the tamper detection and storage of the tamper event in non-volatile memory must be completed before the end of the power supply hold-up period.

In the context of such '322 referenced patent, "hold-up time" refers to the amount of time a power supply can maintain a minimally required output power after line voltage is removed. Non-volatile memory as referred to in such '322 Patent (and as intended to mean in this subject invention) refers to a memory device which is capable of maintaining its stored values for a period of time even without external power sources. One common example of such a non-volatile memory device or means is an EEPROM, i.e., an electrically erasable programmable read only memory. Such a device requires some milliseconds to complete the storage of data, which means that the hold-up time of the associated power supply for the detection circuitry (and other circuitry elements) must be longer than the required data storage time.

In one example in such '322 Patent, motion sensing may be accomplished using a mercury wetted switch that provides contact closure corresponding with the sensing of motion. Storing an indicated tampering event may be accomplished such as by indexing a tamper counter. Even if the tamper counter ultimately rolls over, it is the change in the counter value since last reviewed by personnel that signifies a meter removal (i.e., tampering) event.

As discussed therein, the approach of the '322 Patent may be implemented with various devices, including the use of dedicated hardware devices and/or programmable hardware devices using software implemented logic steps.

The complete disclosure of such U.S. Pat. No. 5,473,322 (including all figures and discussion thereof) is fully incorporated herein by reference.

Additional United States Patents provide examples of metering systems providing for indications of tampering, or other systems for the retrieval of metering data or other communications (such as commands or instructions) with metering devices. Examples include U.S. Pat. Nos. 4,862,493; 4,856,054; 4,850,010; 4,833,618; 4,799,059; 4,786,903; 4,720,851; 4,614,945; 4,588,949; and 4,463,354. The complete disclosures of all such patents (including all figures and descriptions thereof) are fully incorporated herein by reference.

SUMMARY OF THE INVENTION

The present invention recognizes and addresses various of the foregoing limitations and drawbacks, and others, concerning tampering detection. Thus, broadly speaking, a principal object of the subject invention is improved techniques for detecting tampering of electrically powered devices, such as electric meters. More particularly, a main concern is improved methodology and apparatus for efficiently indicating tampering of a residential electric meter, such as involving removal of the meter from its power socket.

Another more particular object of the subject invention is to provide method and apparatus based on detectable physical motion of removing a meter from its socket as an associated detection of the loss of power when electrical contacts of the meter and the socket are separated. In such context, it is a further object to obviate the need for employing relatively complicated (and hence more costly) early power fail detection circuits and power supply hold-up components.

Another general object of the subject invention is to provide an effective tampering detection technique which is not readily defeated by a would be tamperer.

Still another general object is to provide a technique which permits the indication of successive, multiple tampers.

Yet another present object of the invention is to provide relatively remote indications of meter tampering.

It is a further more particular object to provide such improved methodology and apparatus which requires no reset or special equipment to clear any "tamper" indications occurring during normal servicing, because user recording of an indicated tamper count can account for service events.

It is another general object of the present invention to provide improved methodology and apparatus which with a high degree of certainty helps to avoid false positive indications of tampering while ensuring detection of actual instances of tampering.

It is another object to provide improved methodology and apparatus which can be implemented, in part, in either dedicated hardware devices or with programmable hardware using software implemented logic steps.

Additional objects and advantages of the invention are set forth in, or will be apparent to those of ordinary skill in the art from, the detailed description herein. Also, it should be further appreciated that modifications and variations to the specifically illustrated, referenced, and discussed steps, features, materials, or devices hereof may be practiced in various uses and embodiments of this invention without departing from the spirit and scope thereof, by virtue of present reference thereto. Such variations may include, but are not limited to, substitution of equivalent steps, materials, means, or features for those shown, referenced or discussed, and the functional, operational, or positional reversal of various features, steps, parts, or the like.

Still further, it is to be understood that different embodiments, as well as different presently preferred embodiments, of this invention may include various combinations or configurations of presently disclosed steps, features, or elements, or their equivalents (including combinations of steps or features or configurations thereof not expressly shown in the figures or stated in the detailed description). One exemplary such embodiment of the present invention relates to an improved method of sensing tampering of an electrically powered meter. Such method may include steps of sensing the motion of the meter and setting a "Tamper Flag" for a predetermined period of time thereafter. According to the method, the "Tamper Flag" setting is maintained if there is a loss of power to the meter during such predetermined period of time. Per the method, such "Tamper Flag" is cleared if the predetermined period of time passes without loss of power to the meter.

The method further includes detecting a resumption of power after a loss of power to the meter. Per the method, an indication of sensed tampering of the electrically powered meter is provided if the "Tamper Flag" is set upon the detection of resumption of power to the meter.

Such exemplary methodology may further include an additional step following the indication of sensed tampering, including clearing the "Tamper Flag" and recycling the method so as to sense any subsequent tampering of the meter. Additionally, such exemplary method may optionally include transmitting to a device external to the meter data of sensed tampering. The method may also include determining an amount of previously consumed electrical energy at the time of a detected loss of power, and also subsequently transmitting such data of previously consumed electrical energy to a device external to the meter. The exemplary method may also include a step of keeping a count of the number of indications of sensed tampering.

Another present exemplary embodiment concerns a method of detecting tampering of an electrically powered device, such as a utility metering device, specifically, for one example, a single phase electric watt-hour meter. Per such method, displacement of the electrically powered device is detected, and a "Tamper Flag" is set responsive to such displacement detecting. A predetermined timeout period is timed responsive to setting of the "Tamper Flag." Still further per such method, loss of power to the electrically powered device is detected, upon which the displacement detecting operations and timing operations are discontinued.

Further per such exemplary method, the "Tamper Flag" is cleared if the timing step runs for its full predetermined timeout period without detection of a loss of power. Upon detecting a resumption of power after a loss of power, the methodology checks to determine whether the "Tamper Flag" is still set. If the "Tamper Flag" is still set upon such occurrence, a tamper counter is incremented and the "Tamper Flag" is cleared for further operation. Per such exemplary methodology, an increased tamper count reflects the detection of tampering. The total value of the tamper counter would reflect the total number of detected tamperings (less any known specific instances of authorized servicing).

Additional options may be variously practiced with such exemplary methodology, as referenced in conjunction with the first exemplary methodology.

Those of ordinary skill in the art should understand and appreciate that the present invention applies equally to corresponding apparatuses for practicing, using, and/or otherwise implementing such exemplary methodologies. One present exemplary embodiment of such an apparatus is provided for sensing tampering of an electrically powered meter. Such apparatus may comprise non-volatile memory means, meter motion sensing means, timer means, power detecting means, and logic means.

The exemplary non-volatile memory means are provided for the storage of meter associated data in the event of loss of power to such meter. The meter motion sensing means senses motion of the meter and outputs a signal indicative thereof. The exemplary timer means is responsive to the sensed meter motion for establishing the passage of a predetermined period of time after such sensing of meter motion. The power detecting means detects either the presence or loss of power to the meter and outputs corresponding signals thereof.

The foregoing exemplary logic means is preferably functionally operative with all of the other elements of the apparatus, including the non-volatile memory means, the meter motion sensing means, the timer means, and the power detecting means. In its operations and functioning, the logic means operate such that: (i) sensing meter motion results in setting of a designated "Tamper Flag" in the non-volatile memory means for the predetermined period of time; (ii) detected loss of power to the meter within the predetermined period of time results in maintaining the "Tamper Flag" setting in the non-volatile memory means after such loss of power to the meter; (iii) detected presence of power to the meter throughout the predetermined period of time results in clearing of the "Tamper Flag" in the non-volatile memory means; and (iv) detected presence of power to the meter after a detected loss of power thereto while the "Tamper Flag" is set results in providing an indication of sensed tampering of the electrically powered meter.

Additional features may be practiced with such exemplary apparatus, including such that the logic means are further functional, after providing an indication of sensed tampering, for clearing the "Tamper Flag" for further tamper sensing operations. In addition, tamper counter means may be provided for keeping data concerning the number of indications of sensed tampering. Still further, various forms of data transmission means may be provided for transmitting to a device external to the meter data of sensed tampering.

Yet another construction comprising an exemplary present apparatus for detecting tampering of an electrically powered device (such as an electric meter), includes position detection means, power detecting means, timer means, and logic means.

In such exemplary embodiment, the position detection means operates for outputting a device motion signal upon detecting displacement of such device, which function includes setting a tamper flag in a memory. The exemplary power detecting means functions for detecting a loss of power to the device and for outputting signals indicative of whether or not power has been lost. The exemplary timer means is responsive to setting of the tamper flag and signals of the power detecting means for outputting a predetermined timeout period signal if the tamper flag remains set a predetermined period of time without loss of power.

The logic means of such exemplary apparatus is preferably responsive to the timer means and the power detecting means, upon resumption of power after a power loss, for incrementing a tamper count and for clearing the stored tamper flag if the predetermined timeout period signal is not received from the timer means before resumption of power. Such logic means is operative for clearing the stored tamper flag without incrementing a tamper count if the predetermined timeout period signal is received from the timer means before resumption of power.

Such exemplary apparatus may further include non-volatile memory means for storage of the tamper flag data. Still further, it may optionally include data transmission means for transmitting to an external device data of the tamper count, so that data about detected tampering is indicated relatively remotely from the electrically powered device, such as a meter.

Still a further exemplary apparatus for indicating tampering of an electrically powered electric utility metering device may include non-volatile memory means, meter motion sensing means, power detecting means, timer means, logic means, tamper counter means, and data transmission means, all as described in greater detail herein.

Still further, it is to be understood that all of the apparatuses described herein, and practice of the various methodologies referenced or discussed, may involve various combinations of dedicated hardware and/or programmable hardware devices using software implemented logic steps.

Those of ordinary skill in the art will better appreciate the features and aspects of such embodiments (both apparatus and methodology), and others, upon review of the remainder of the specification.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
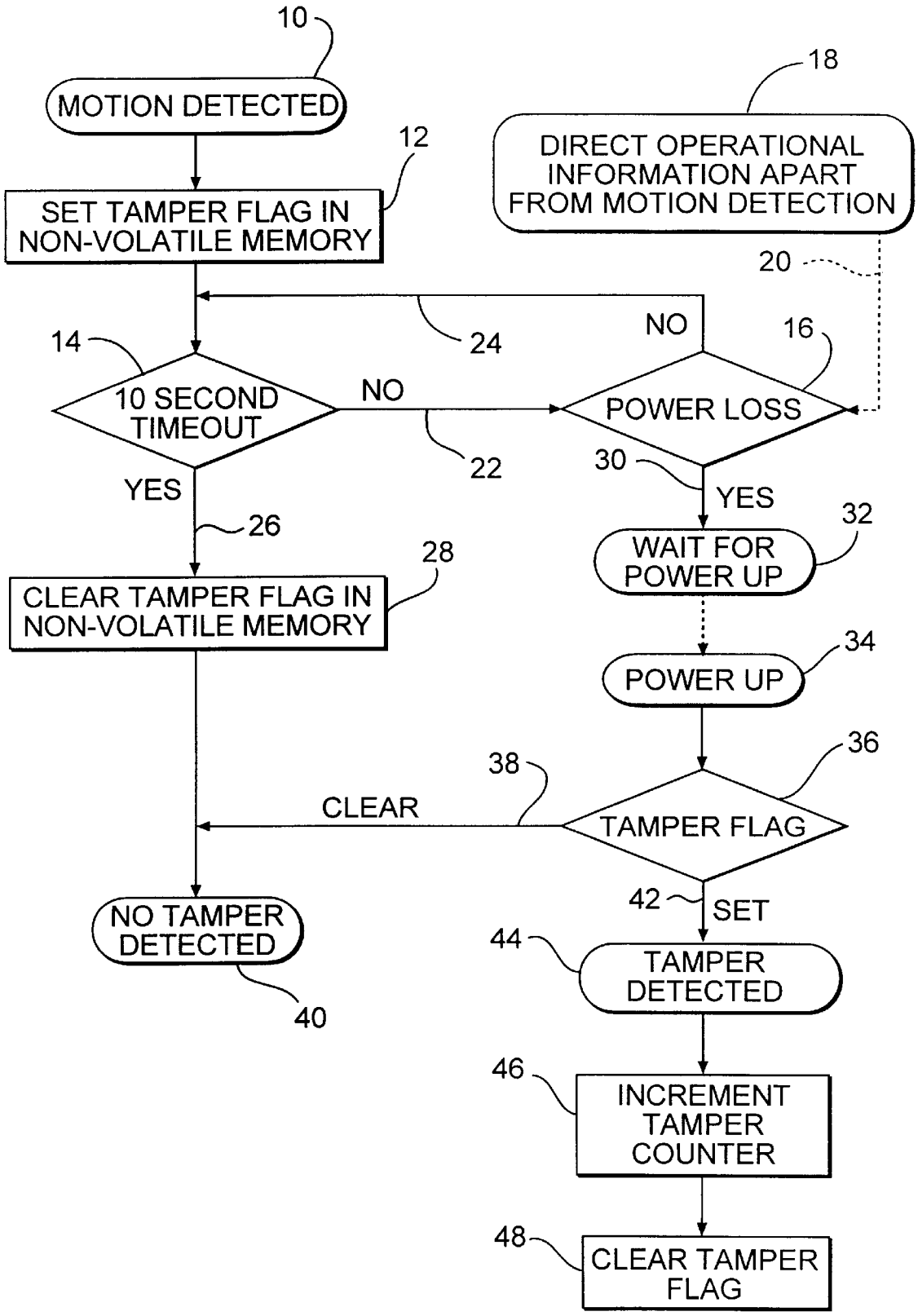
FIG. 1 is a logic flow chart by which one of ordinary skill in the art could implement practice of various embodiments of the subject invention in either dedicated hardware and/or programmable hardware utilizing software implemented logic steps (or combinations thereof)

Repeat use of reference characters throughout the present specification and appended drawings is intended to represent same or analogous features, steps, or elements of the invention.

DETAILED DESCRIPTION OF THE PREFERRED EMBODIMENTS

While the particulars of the subject invention may be adapted for use in detecting tampering of various types of electrically powered devices, the examples discussed herein are primarily in the context of electric utility meters, such as an electric watt-hour meter as might be used at a residential installation. It is to be further understood that the subject application fully incorporates by reference the complete disclosure and subject matter of commonly owned U.S. Pat. No. 5,473,322.

In exemplary broad terms, in the context of functioning with an electrically powered meter, the subject invention involves sensing motion of such meter and setting a "Tamper Flag" for a predetermined period of time thereafter. Such "Tamper Flag" is saved if there is a loss of power within such time, but cleared if there is no loss of power within such time. Upon detecting a resumption of power after a loss of power, an indication of sensed tampering is made if the "Tamper Flag" is found to be set upon such resumption of power.

The efficiency in the operations of the subject invention are based on certain definitions and/or assumptions and/or factual circumstances which may not be self-evident from the present figures, discussed in greater detail below. First, it should be understood by those of ordinary skill in the art that tampering in the context of the subject invention (as applied to the example of an electric meter) involves meter removal for access in order to tamper and eventual reinsertion of the meter. A person seeking to defraud an electric utility company of revenue might leave a removed meter out of its corresponding power socket for some relatively longer period of time (e.g., such as days). However, such user will eventually be motivated to replace the meter in order to avoid detection (in their belief), such as would otherwise be anticipated by the user when eventually utility personnel come to the meter site for routine reading and/or servicing of such meter.

Another aspect of such view of tampering is that the connection of electric power to the meter is broken as part of its removal from its power socket. Practice of embodiments of the subject invention is based on the assumption that there will be detectable motion of the meter whenever it is removed adequately to break the power connection thereto. As referenced above, there is also the assumption that the meter will be again powered eventually, in order to complete the fraudulent act. If a person defrauding the utility company continually left the meter removed from its power socket, without regard to periodic readings and/or inspections by utility personnel, then eventually such fact of fraud would become directly observed by the utility company personnel, even absent practice and full operation of the subject invention.

As part of the present advantages of avoiding the necessity of having relatively complicated and/or costly support circuitry for early detection of loss of power and for adequate hold-up time during powering down, the present methodology and apparatus are made effective regardless of the fact that there is no motion detection operation or any timing of a predetermined period of time if there is a loss of power to the electrically operated device (e.g., electric meter).

With more specific reference to the subject features, FIG. 1 represents a logic flow chart by which one of ordinary skill in the art may understand steps which may be implemented in either dedicated hardware or programmable hardware with computer software implementation (or combinations thereof), for practice of various embodiments of the subject invention.

As represented by such FIG. 1 (as well as by FIG. 2), it should be further understood by those of ordinary skill in the art that the subject methodology may involve processes or functions which are operating simultaneously in some instances, consecutively in some instances, and repetitively in some instances. In other words, various aspects of the subject invention may operate independently from one another, as well as in reaction to changing characteristics associated with the meter (or device) with which the invention is practiced. As a result, no one flow chart, moving from a single beginning point to a single end point, without some explanation, can readily describe the subject invention.

Likewise, the subject matter of the claims set forth in the subject application convey and cover like subject matter. In other words, those of ordinary skill in the art will appreciate that "steps" recited for the present methodology do not necessarily mean or intend a specific and singular chronological order thereof, as will be otherwise completely understood by those of ordinary skill in the art from the full disclosure throughout the present application.

FIG. 1 reflects that detection of motion of the device or meter step 10 is one driving factor of the invention. Once such motion is sensed, a "Tamper Flag" is written per step 12, preferably such as to a non-volatile memory means.

The purpose of subsequent decisional block 14 is to determine whether power is lost within a predetermined period of time. Such function operates simultaneously with operation of the decisional block 16, which otherwise is always directly operating on power information apart from motion detection, to determine whether there is a loss of power to the associated device or meter. Such direct operational information 18 is placed directly into power loss decisional block 16 along indicated dotted line path 20. Such pathway 20 exists and functions completely apart from pathway 22, by which the overall methodology is implicitly aware that the "Tamper Flag" has been set.

As understood by those of ordinary skill in the art, as long as the predetermined period of time per decisional block 14 has not elapsed, the "No" branch 22 emerging from decisional block 14 directs consideration concurrently of the loss of power decisional block 16. So long as there is no loss of power, the "No" branch 24 of loss of power decisional block 16 directs continued consideration of whether the predetermined time period of decisional block 14 has elapsed.

As will be clear to those of ordinary skill in the art from FIG. 1 and its associated discussion, if power to the device or meter is not lost within the predetermined set period of time, eventually the loop created with pathways 22 and 24 will lead to a "Yes" pathway 26 of timeout period decisional block 14, which results in accordance with the invention in operation of step 28 for clearing the "Tamper Flag" set in non-volatile memory.

If there is a loss of power to the device or meter, flow continues from decisional block 16 through its "Yes" branch 30, which diverts activity away from its "No" branch 24. Therefore, the operation of decisional block 14 is rendered moot, which means that if power is lost it is no longer under consideration as to whether the predetermined period of time has lapsed without clearance of the set "Tamper Flag."

In other words, if power is lost within the predetermined period of time, the "Tamper Flag" remains set throughout the power outage. If power is not lost within such predetermined period of time, the "Tamper Flag" is cleared.

Further reviewing operation of the present methodology, if there is a power loss (branch 30), the method further waits for power to be returned, per step 32. This amounts to a continued determination of a detection of whether there is a presence or loss of power to the associated device or meter. An indication of a return of power after a power loss is represented by step 34. Upon such restoration of power, the present methodology operates through a decisional block 36 to consider whether the "Tamper Flag" is set or cleared. A determination at such time and upon such conditions that the "Tamper Flag" is clear results in proceeding along branch 38, by which no tamper is detected per step 40. In accordance with the preferred embodiments of the subject invention, the present methodology continues to operate from such conditions, which means that any potential subsequent tamper events continue to be monitored.

If operation of decisional branch 36 at such time and under such conditions determines that the "Tamper Flag" is set, the present methodology proceeds along pathway 42 for determining per step 44 that a tamper has been detected in accordance with the subject invention.

At such juncture (step 44: "Tamper Detected"), various alternatives may be practiced. In the representative logic flow chart of present FIG. 1, one option is indicated per step 46 as incrementing a tamper counter. Such feature results simultaneously in indication of a tamper detection, and also facilitates keeping a running total of tamper detections. Since authorized service access to the device or meter likewise results in indication of a "tamper" detection, one need only track records of such authorized events for deduction from any indicated tamper counter for step 46 to determine a net number indicative of the number of unauthorized tampers. In any event, further operation of step 48 results in clearing of the "Tamper Flag" for further monitoring of potential tamper events in accordance with the subject invention.

As referenced above, the subject methodology is based on there being motion of the device or meter as it is removed from its power socket or other receptacle. At some point in any such removal of a meter, the connection to AC power will be broken. While either the detection of motion or detection of the loss of power could be used to initiate a tamper detection algorithm, the present invention beneficially addresses the detection of motion based on an assumption that motion can be detected at a point the meter has been sufficiently moved for breaking contact with the AC connection.

By initiating a tamper detection methodology or algorithm with the detection of motion, any such sequence or methodology is started at its earliest point. With the "Tamper Flag" being written immediately to non-volatile memory, the methodology or algorithm does not have to wait for any early detection of power failure and the delays inherently associated with such detection. For example, some approaches to detecting power failure may monitor AC line frequency and detect missing line cycles. At 60 Hz, it would be at least 16.7 mS before a missing cycle is determined. If one were using a write to EEPROM (as an example of a non-volatile memory) with a write time of 10 mS, such a write function could have already been accomplished. However, other exemplary methods, such as those of monitoring the AC line amplitude or rectified unregulated voltage for power failure detection, could involve delays of time which would take the operation outside of acceptable time limits.

In accordance with the subject invention, although an actual tamper of the meter (or device) may have occurred with the motion and loss of power, the methodology or algorithm of the subject invention does not make an indication of (i e., does not log) the tamper event until power is restored to the meter or device. Such data or information about indicated tampering is not lost because the "Tamper Flag" is set in non-volatile memory and the meter ultimately will again be powered to complete the fraudulent act.

In accordance with the subject invention, upon restoration of power, the "Tamper Flag" is read from the non-volatile memory. With such flag set, a tamper has been detected and a tamper counter may be incremented. Such a counter, as referenced above, may be used to record tampers for many reasons. Such methodology does not require a reset at any time, only recording of the tamper counter value. Such value may be allowed to roll over and still indicate tampering and the number of tampers. Normal servicing of the meter may cause a tamper detection, but no reset or special equipment would be needed, only recording of the count when servicing is complete.

In accordance with the subject invention, for the set of conditions where power is restored and the "Tamper Flag" is not set, the tamper counter is not incremented. For the circumstances where motion is detected and the "Tamper Flag" is set in memory, but there is no associated power outage within the given predetermined period of time, the tamper counter is not incremented. At the end of such predetermined period of time, the "Tamper Flag" is cleared from memory. The period of time must be greater than the time between when the motion was first detected and the removal of the meter and decay of the power supply to the circuit.

In the presently preferred exemplary embodiment, the predetermined period of time is set for a preferred exemplary 10 seconds. It is to be understood that variations may be practiced, strictly for example, such as from one second to two minutes, so long as the time is not so short as to cause the omission of an actual tamper indication nor too long as to cause false indication of a tamper. Other more restricted ranges may be practiced by those of ordinary skill in the art, depending on various factors for their particular circumstances, and ranges outside of the broader ranged referenced above may likewise be practiced in certain instances. In some examples, ranges of from two seconds to thirty seconds, from five seconds to fifteen seconds, and others, may be practiced.

By utilizing and incorporating a predetermined period of time, the present invention may distinguish circumstances where motion is detected but no accompanying loss of power occurs. Such "false" indications of potential tampering may be caused by a number of totally innocent circumstances. For example, a child's ball striking the meter might result in a detection of motion. Likewise, the close passing of a large truck or a minor earthquake or other tremor could result in the indication of motion. Likewise, some other object striking the meter, such as a falling limb, could by itself cause a detection of motion per step 10, any one of which events would cause the "Tamper Flag" to be set in memory, per step 12. However, unless an accompanying loss of power occurred within the predetermined period of time determined by decision step 14, such "Tamper Flag" would ultimately be cleared per step 28 in accordance with the subject invention.

Still further, it is to be understood by those of ordinary skill in the art from the logic flow chart of present FIG. 1 that a loss of power can occur without resulting in indication of tampering. As well known to those of ordinary skill in the art, even the most efficiently operated power systems can sometimes experience a power outage, such as due to a vehicle accident downing power lines or other uncontrolled causes. If no motion detection within the predetermined time period has occurred in accordance with the subject invention, any such power loss would not result in indication of tampering. Accordingly, a false positive indication of tampering would be avoided.

Figure 2:
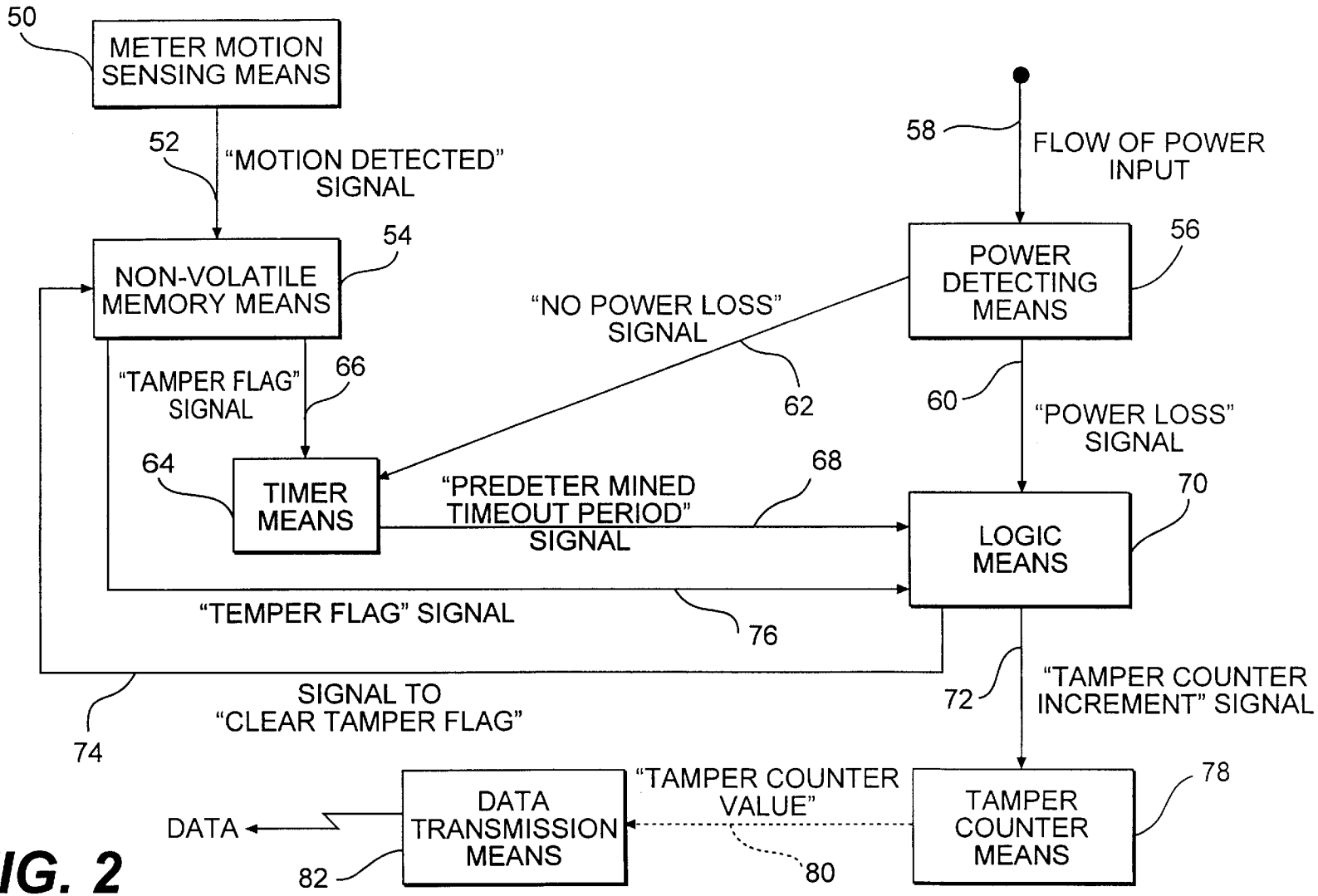
FIG. 2 is a functional block diagram, illustrating further aspects and options of various embodiments of the subject invention, still permitting user selected practices of either dedicated hardware and/or programmable hardware with software implementation (or combinations thereof).

Those of ordinary skill in the art should appreciate that the present exemplary embodiments of the present methodologies may be practiced in conjunction with various apparatuses, including various combinations of dedicated hardware and/or programmable hardware with computer software implementation of logic steps. FIG. 2 is intended to be a representative functional block diagram of various apparatuses in accordance with the subject invention, for practicing the above-referenced methodologies. It is to be understood that the disclosure of U.S. Pat. No. 5,473,322 which is fully incorporated herein by reference represents specific examples of exemplary dedicated hardware and programmable hardware which may be practiced in accordance with the subject invention. All such variations indicated therein are intended to come within the spirit and scope of the present invention, by virtue of present reference thereto.

In exemplary FIG. 2, meter motion sensing means 50 are provided for sensing motion of the device or meter and for outputting a "Motion Detected" signal 52 thereof. Such motion sensing means may, for example, constitute a tilt switch, such as a mercury wetted switch and associated operative circuitry.

Such sensing means or position detection means 50 in accordance with the subject invention may detect positional displacement of the device or meter, such as from a power socket, in which it is otherwise intended to be received during normal metering operations thereof. In other instances, such position detection means may comprise means for detecting acceleration of the device or meter as it is removed from such a power socket in which it is otherwise intended to be received during normal metering operations thereof. In certain embodiments, the meter motion sensing means may directly cause setting of a tamper flag in a memory device.

As further represented in present FIG. 2, a separate non-volatile memory means generally 54 may be provided for storing a designated "Tamper Flag" as being either set or cleared. In certain optional aspects, such non-volatile memory means may be operative for the storage of other data associated with the device, such as metering data for an electric meter, reflecting consumed electric energy. Still further, such non-volatile memory means could be utilized in certain embodiments for registering a total number of indicated sensed tampers.

A variety of non-volatile memories are well known to those of ordinary skill in the art, and may optionally be practiced with various embodiments of this invention.

Power detecting means generally 56 may be provided in accordance with the subject invention, responsive to an input of a flow of power generally 58 to the associated device or meter. Such power detecting means is operative for detecting the presence or loss of power to such associated device and for outputting signals indicative of whether or not power has been lost, as represented by "Power Loss" output signal line 60 and "No Power Loss" output signal line 62 therefrom. Various arrangements for detecting the presence or loss of power to a device, such as an electric meter, are well known to those of ordinary skill in the art, and form no particular aspect of the subject invention. Any of such variations may, in general, be practiced depending on the particulars of an embodiment utilized by those of ordinary skill in the art.

As further represented by present FIG. 2, the signal line 62 from power detecting means 56 is advanced to a timer means generally 64. Such timer means is also responsive to setting of the "Tamper Flag" per a signal 66, for outputting a "Predetermined Timeout Period" signal generally 68 if the "Tamper Flag" remains set a predetermined period of time without loss of power. As referenced above, such predetermined period of time may vary in accordance with the subject invention, with one exemplary preferred embodiment having a time of about ten seconds.

As represented to those of ordinary skill in the art from present FIG. 2, logic means generally 70 in accordance with the subject invention receives a variety of inputs and indicates a variety of outputs. Either directly or indirectly, logic means 70 are functionally operative with meter motion sensing means or position detection means 50, non-volatile memory means 54, timer means 64, and power detecting means 56. Responsive thereto, logic means operates upon resumption of power after a power loss for incrementing a tamper count (such as by outputting a "Tamper Counter Increment" signal 72) and clearing the stored "Tamper Flag" (such as by a "Clear Tamper Flag" signal 74), if the "Predetermined Timeout Period" signal 68 is not received before resumption of power. Logic means 70 is operative for clearing the stored "Tamper Flag" (such as via signal 74) if the "Predetermined Timeout Period" signal 68 is received before resumption of power. In such instance, the tamper count is not incremented.

As further represented by present FIG. 2, logic means 70 is "aware" of the condition of the "Tamper Flag" by virtue of signal 76 represented as being directly communicated from non-volatile memory means 54 to logic means 70.

The functionality block diagram of present FIG. 2 represents an optional facet of the subject invention, by which some embodiments thereof may include tamper counter means generally 78 responsive to output signal 72 of logic means 70 for correspondingly increasing a "Tamper Counter Value" thereof. Still further, with or without such tamper counter means 78 (as represented by the use of a dotted line 80), other embodiments of the present invention may optionally make use of data transmission means generally 82. Through function of such data transmission means 82, data, such as concerning a "Tamper Counter Value" may be transmitted to locations relatively remote from the device or electric meter, such that tampering of such device may be relatively remotely indicated.

As referenced above, the associated device may comprise a metering device, such as a single phase electric watt-hour meter, and the non-volatile memory means may also store electric energy consumption data obtained from such metering device during loss of power thereto. In such embodiments, the data transmission means may also be utilized for transmitting such electric energy consumption data to a relatively remote location.

It is to be understood that the subject matter incorporated by reference from U.S. Pat. No. 5,473,322 discloses additional details of exemplary embodiments of various devices which may be used in accordance with the subject invention, or adapted for use therewith. For example, the timer means 64 may be provided as a dedicated hardware device or may be incorporated into computer software of a programmable hardware device. Likewise, various aspects of the logic means 70 and tamper counter means 78 may be comprised of combinations of dedicated hardware devices and/or various programmable hardware devices using software implemented logic steps in accordance with the subject invention, all as well understood by those of ordinary skill in the art without requiring additional detailed discussion.

Similarly, it is to be understood that data transmission means 82 may make use of various wire based communication circuitries (such as across telephone lines or power lines) or RF based communication circuitries. Additional communication modes could include Internet communications, either wire or RF based.

Still further, it is to be understood that the present invention may be practiced in conjunction with combinations of additional features, not necessarily shown or discussed in detail. For example, various transceiver means may be utilized in combination with various embodiments of the subject invention, by which an associated electric meter device (or other device) may receive instructions or commands, such as to transmit a tamper counter value to indicate data representative of the number of sensed tamper events, or to transmit data concerning consumed electrical energy.

Yet further, even in the context of electric meters, various different embodiments may be practiced, such as incorporated into a single phase induction type electric watt-hour meter, or other types of electric watt-hour meters including polyphase induction and single phase solid state watt-hour meters.

Likewise, the present invention may be practiced in conjunction with other forms of utility meters (such as water or gas, as applicable) and in combination with other remote monitoring equipment and/or equipment providing instructions and commands to the receiving devices.

It should be further understood by those of ordinary skill in the art that the foregoing presently preferred embodiments are exemplary only, and that the attendant description thereof is likewise by way of words of example rather than words of limitation, and their use does not preclude inclusion of such modifications, variations, and/or additions to the present invention as would be readily apparent to one of ordinary skill in the art, the scope of the present invention being set forth in the appended claims.

What is claimed is:

1. A method of sensing tampering of an electrically powered meter, including the steps of:

(a) sensing motion of said meter and setting a "Tamper Flag" for a predetermined period of time thereafter;

(b) maintaining said "Tamper Flag" setting if there is a loss of power to said meter during said predetermined period of time;

(c) clearing said "Tamper Flag" if said predetermined period of time passes without loss of power to said meter;

(d) detecting a resumption of power after a loss of power to said meter; and (e) providing an indication of sensed tampering of said electrically powered meter if said "Tamper Flag" is set upon said detection of resumption of power to said meter.

2. A method as in claim 1, wherein said electrically powered meter comprises an electric watt-hour meter, and said sensing motion step includes detecting positional displacement of said meter from a power socket in which it is otherwise intended to be received during normal metering operations thereof.

3. A method as in claim 1, wherein said step of providing an indication of sensed tampering is followed by the step of clearing said "Tamper Flag" and recycling said method so as to sense any subsequent tampering of said meter.

4. A method as in claim 3, further including the step of keeping a count of the number of indications of sensed tampering.

5. A method as in claim 1, further including the step of subsequently transmitting to a device external to said meter data of sensed tampering.

6. A method as in claim 5, further including the steps of:

detecting a loss of power to said meter;

determining an amount of previously consumed electrical energy at the time of a detected loss of power; and subsequently transmitting to a device external to said meter data of previously consumed electrical energy.

7. A method as in claim 1, wherein said predetermined period of time is generally in a range of from about one second to about two minutes.

8. A method as in claim 7, wherein said range is generally from about two seconds to about thirty seconds.

9. A method as in claim 8, wherein said predetermined period of time is about ten seconds.

10. A method of detecting tampering of an electrically powered device, including the steps of:

(a) detecting a displacement of said electrically powered device;

(b) setting a "Tamper Flag" responsive to said displacement detecting step;

(c) timing for a predetermined timeout period responsive to said setting "Tamper Flag" step;

(d) detecting a loss of power to said electrically powered device;

(e) discontinuing said displacement detecting step and said timing step if a loss of power is detected;

(f) clearing said "Tamper Flag" if said timing step runs for the full predetermined timeout period without detection of a loss of power;

(g) detecting a resumption of power after a loss of power;

(h) upon resumption of power, checking whether said "Tamper Flag" is set; and (i) if said "Tamper Flag" is set, incrementing a tamper counter and clearing said "Tamper Flag", such that an increased tamper counter reflects the detection of tampering.

11. A method as in claim 10, further including the step of transmitting tamper counter data to an external device so that detection of tampering is indicated relatively remotely from said electrically powered device.

12. A method as in claim 10, wherein said electrically powered device is a utility metering device.

13. A method as in claim 12, further including the step of storing in non-volatile memory energy consumption data of said utility metering device, upon the detection of loss of power thereto.

14. A method as in claim 12, wherein said predetermined timeout period is generally in a range of from about one second to about two minutes.

15. A method as in claim 14, wherein said predetermined timeout period is from about five seconds to about fifteen seconds.

16. A method as in claim 12, wherein said utility metering device is a single phase electric watt-hour meter.

17. A method as in claim 16, wherein said detecting displacement step includes detecting positional displacement of said meter from a power socket in which it is otherwise intended to be received during normal metering operations thereof.

18. Apparatus for sensing tampering of an electrically powered meter, comprising:

non-volatile memory means for the storage of meter associated data therein in the event of loss of power to said meter;

meter motion sensing means for sensing motion of said meter and for outputting a signal indicative thereof;

timer means, responsive to sensed meter motion for establishing the passage of a predetermined period of time after sensing meter motion;

power detecting means for detecting the presence or loss of power to said meter and for outputting corresponding signals thereof; and logic means, functionally operative with said non-volatile memory means, said meter motion sensing means, said timer means and said power detecting means for functioning such that:

(i) sensing meter motion results in setting of a designated "Tamper Flag" in said non-volatile memory means for said predetermined period of time;

(ii) detected loss of power to said meter within said predetermined period of time results in maintaining said "Tamper Flag" setting in said non-volatile memory means after such loss of power to said meter;

(iii) detected presence of power to said meter throughout said predetermined period of time results in clearing of said "Tamper Flag" in said non-volatile memory means; and (iv) detected presence of power to said meter after a detected loss of power thereto and while said "Tamper Flag" is set results in providing an indication of sensed tampering of said electrically powered meter.

19. An apparatus as in claim 18, wherein:

said electrically powered meter comprises an electric watt-hour meter; and said meter motion sensing means is operative for detecting positional displacement of said meter from a power socket in which it is otherwise intended to be received during normal metering operations thereof.

20. An apparatus as in claim 18, wherein said meter comprises an electric watt-hour meter and said non-volatile memory means are further functional for storing electric energy consumption data during loss of power to said meter.

21. An apparatus as in claim 18, wherein said logic means comprises dedicated hardware devices.

22. An apparatus as in claim 18, wherein said logic means includes programmable hardware devices using software implemented logic steps.

23. An apparatus as in claim 18, wherein said logic means are further functional, after providing an indication of sensed tampering, for clearing said "Tamper Flag" for further tamper sensing operations.

24. An apparatus as in claim 23, further including tamper counter means for keeping data concerning the number of indications of sensed tampering.

25. An apparatus as in claim 18, further including data transmission means for transmitting to a device external to said meter data of sensed tampering.

26. An apparatus as in claim 25, wherein said data transmission means is also operative for transmitting to a device external to said meter data of previously consumed electrical energy as determined by said meter.

27. An apparatus as in claim 18, wherein said predetermined period of time is generally in a range of from about one second to about two minutes.

28. An apparatus as in claim 27, wherein said range is generally from about two seconds to about thirty seconds.

29. An apparatus as in claim 28, wherein said predetermined period of time is about ten seconds.

30. An apparatus for detecting tampering of an electrically powered device, comprising:

position detection means for outputting a device motion signal upon detecting displacement of said device, including setting a tamper flag in memory;

power detecting means for detecting a loss of power to said device and for outputting signals indicative of whether or not power has been lost;

timer means, responsive to setting of said tamper flag and signals of said power detecting means for outputting a predetermined timeout period signal if said tamper flag remains set a predetermined period of time without loss of power; and logic means, responsive to said timer means and said power detecting means, upon resumption of power after a power loss, for incrementing a tamper count and for clearing said stored tamper flag if said predetermined timeout period signal is not received from said timer means before resumption of power, and for clearing said stored tamper flag without incrementing a tamper count if said predetermined timeout period signal is received from said timer means before resumption of power.

31. An apparatus as in claim 30, wherein said electrically powered device is a utility metering device.

32. An apparatus as in claim 31, wherein said utility metering device is a single phase electric watt-hour meter.

33. An apparatus as in claim 31, further including non-volatile memory means for storage of said tamper flag.

34. An apparatus as in claim 31, wherein said logic means comprises programmable hardware devices using software implemented logic steps.

35. An apparatus as in claim 31, wherein said logic means comprises dedicated hardware devices.

36. An apparatus as in claim 31, wherein:

said metering device comprises an electric watt-hour meter; and said position detection means comprises means for detecting acceleration of said meter as it is removed from a power socket in which it is otherwise intended to be received during normal metering operations thereof.

37. An apparatus as in claim 31, further including data transmission means for transmitting to an external device data of said tamper count, so that data about detected tampering is indicated relatively remotely from said metering device.

38. An apparatus as in claim 37, further including:

non-volatile memory means for storage of data from said metering device about previously consumed electrical energy; and wherein said data transmission means is also operative for transmitting to an external device data of such previously consumed electrical energy as stored in said non-volatile memory means.

39. An apparatus as in claim 31, wherein:

said metering device comprises an electric watt-hour meter; and said position detection means comprises means for detecting positional displacement of said meter from a power socket in which it is otherwise intended to be received during normal metering operations thereof.

40. An apparatus as in claim 39, wherein said position detection means includes a mercury tilt switch and operative circuitry therewith.

41. An apparatus as in claim 31, wherein said predetermined period of time is generally in a range of from about one second to about two minutes.

42. An apparatus as in claim 41, wherein said range is generally from about two seconds to about thirty seconds.

43. An apparatus as in claim 42, wherein said predetermined period of time is about ten seconds.

44. Apparatus for indicating tampering of an electrically powered electric utility metering device, comprising:

non-volatile memory means, operative during loss of power to said metering device, for storing selected data concerning said metering device including a designated "Tamper Flag,"

meter motion sensing means for sensing motion of said metering device and, responsive thereto, setting said "Tamper Flag" in said non-volatile memory means;

power detecting means for alternately detecting the presence and loss of power to said metering device and for outputting corresponding signals indicative thereof;

timer means, responsive to setting of said "Tamper Flag" in said non-volatile memory means and operative only while power is present to said metering device, for timing for a predetermined period of time from the setting of said "Tamper Flag" and for outputting a predetermined timeout period signal at the successful conclusion of such predetermined period of time;

logic means, operatively associated with said non-volatile memory means, said timer means and said power detecting means, (a) for clearing said "Tamper Flag" in said non-volatile memory means if said timer means outputs said predetermined timeout period signal and (b) for outputting a "Tamper Counter Increment" signal and subsequently clearing said "Tamper Flag" in said non-volatile memory means if said "Tamper Flag" is set at a time whenever said logic means receives an indicating signal from said power detecting means indicating the presence of power to said metering device after having received an indicating signal therefrom indicating the loss of power to said metering device;

tamper counter means responsive to said "Tamper Counter Increment" signal from said logic means for correspondingly increasing a "Tamper Counter Value" thereof; and data transmission means for transmitting data concerning said "Tamper Counter Value" to locations relatively remote from said metering device, such that tampering of said metering device may be relatively remotely indicated.

45. Apparatus as in claim 44, wherein:

said metering device comprises a single phase electric watt-hour meter;

said non-volatile memory means stores electric energy consumption data from said metering device during loss of power thereto; and said meter motion sensing means comprises means for detecting the positional displacement of said metering device from a power socket in which it is otherwise intended to be received during normal metering operation thereof.

46. Apparatus as in claim 44, wherein said data transmission means comprises one of a wire based communication circuitry and RF based communication circuitry.

47. Apparatus as in claim 46, wherein said timer means comprises one of a dedicated hardware implemented device and a software implemented device.

48. Apparatus as in claim 47, wherein said predetermined period of time is generally in a range of from about one second to about two minutes.

49. Apparatus as in claim 48, wherein said logic means and said tamper counter means are implemented with dedicated hardware.

50. Apparatus as in claim 48, wherein said logic means and said tamper counter means are integrally implemented in programmable hardware using software implemented logic steps.

* * * * *